United States Patent [19]

Bellio

[11] Patent Number: 4,567,990

[45] Date of Patent: Feb. 4, 1986

[54] SELF-BALANCING CRANE

[76] Inventor: Stephen L. Bellio, 16 Nottingham Rd., Lynnfield, Mass. 01940

[21] Appl. No.: 523,723

[22] Filed: Aug. 16, 1983

[51] Int. Cl.[4] ..... B66C 23/76; B66C 23/04

[52] U.S. Cl. ..... 212/196; 212/182; 212/197; 212/231; 212/227

[58] Field of Search ..... 212/156, 178, 191, 195–198

[56] References Cited

U.S. PATENT DOCUMENTS

| | | | |
|---|---|---|---|
| 970,773 | 9/1910 | Wylie | 212/196 |
| 3,340,907 | 9/1967 | Bily | 212/196 |
| 3,455,333 | 7/1969 | Bily | 212/156 |
| 3,743,049 | 7/1973 | Levriri | 212/196 |
| 4,025,055 | 5/1977 | Strolenberg | 212/191 |
| 4,155,463 | 5/1979 | Buzzichellil | 212/196 |

FOREIGN PATENT DOCUMENTS

| | | | |
|---|---|---|---|
| 510886 | 3/1955 | Canada | 212/156 |
| 216077 | of 0000 | Fed. Rep. of Germany | 212/195 |
| 809350 | 7/1951 | Fed. Rep. of Germany | 212/195 |
| 970083 | 8/1958 | Fed. Rep. of Germany | 212/196 |
| 402344 | 1/1934 | United Kingdom | 212/196 |
| 549410 | 4/1977 | U.S.S.R. | 212/196 |

*Primary Examiner*—Trygve M. Blix
*Assistant Examiner*—R. B. Johnson
*Attorney, Agent, or Firm*—Weingarten, Schurgin, Gagnebin & Hayes

[57] ABSTRACT

A pivoted arm counterbalance system for a self balancing crane provides a counterbalancing moment exactly equal to the overturning moment of the crane by the utilization of a dynamic balancing system in which a drive cable having a tension related to the tension of the support cable runs over and is secured to a constant radius sector secured to the counterbalance arm. The pivot point of the sector corresponds to the pivot point of the counterbalancing arm such that the constant radius sector provides a constant lever arm regardless of the counterbalance arm angle.

1 Claim, 9 Drawing Figures

SELF-BALANCING CRANE

BACKGROUND OF THE INVENTION

This invention relates to self-balancing cranes, and more particularly to a dynamic counterbalancing system in which the counterbalancing moment is exactly equal and opposite to the overturn moment of the crane.

BACKGROUND OF THE INVENTION

In the past, various methods have been utilized for automatically balancing cranes to compensate not only for the weight of the crane boom, but also for the weight of the object lifted by the crane. Counterbalancing methods both for truck-mounted as well as tower cranes can be conveniently categorized into two groups. One group involves the translation of a counterweight in order to provide the appropriate counterbalancing moment, and another group involves a pivoted counterbalance arm which is swung out to vary the counterbalancing moment.

U.S. Pat. Nos. 1,343,630; 1,756,106; 1,718,434; 1,759,406; 2,082,889; 2,368,268; 2,916,172; 2,978,115; 3,642,148; 3,713,544; and 3,924,753 are illustrative of translating weight counterbalance systems in which a counterweight translates in a horizontal direction. The position of the horizontally-movable counterweight is provided by a system which measures the overturn moment of the crane, followed by the positioning of the counterweight such that balance is maintained.

A major disadvantage of translating counterweight-type systems is that complex control is required for measuring the overturning moment and for moving the counterweight to its proper position. Another disadvantage is that such translating counterweight systems are not fail-safe in that a tremendous moment can be created if the load on the boom suddenly disappears as with the breaking of the support cable. This leaves the counterweight positioned away from the center of balance of the crane when the cable breaks. In general, it takes a considerable amount of time for the counterweight to be moved towards the center balance of the crane, which can result in the overturn of the crane with cable breakage.

With respect to prior rotating arm counterbalance systems, these systems utilize an arm pivoted about a fixed point on the crane structure, with a counterweight being attached to the free end of the arm. The counterbalance arm rotates about a pivot pin which has an axis transverse to the axis of the boom in a vertical plane parallel to that which includes the boom. As a load is lifted, a torque is applied to the counterbalance arm, and the arm rotates back and up. The angle of the rotation of the counterbalance arm may be set either by boom position or by the tension in the cable attached to the load. U.S. Pat. Nos. 1,195,058; 1,245,186; 1,344,659; 2,130,487; 2,408,500; 2,759,563; 3,653,486; and 4,155,463 are patents which illustrate the positioning of the rotating counterbalance arm by boom position. Such systems are also illustrated by British Pat. No. 402,344, Swedish Pat. No. 103,945, and German Pat. No. 2,344,051. In all of these patents, the counterbalance arm position is related to boom position as would be appropriate for static balancing systems. Moreover, a major disadvantage of these types of systems is that they do not compensate for the overturning moment created by the loads being picked up by the boom.

Moreover, U.S. Pat. No. 142,740 shows a hybrid system utilizing cable tension and a slung counter weight to effectuate a certain amount of balancing.

For rotating counterbalancing arms positioned by cable tension, as the load is hoisted, tension in the cable increases. Since this cable is utilized directly to position the counterbalance arm, it is the tension in the cable which provides for the angular displacement of the arm as the load is lifted. U.S. Pat. Nos. 3,240,353 and 3,266,636 illustrate a rotating counterbalancing arm system responsive to cable tension, as does French Pat. No. 1,413,966. In all of the last-mentioned patents, the counterbalancing provided by the rotating counterbalancing arm is nonexact in that the effective lever arm utilized to move the counterbalancing weight varies in length with the angle of the counterbalancing arm relative to the local vertical. Thus the counterbalancing moment provided by the counterbalancing arm does not equal the overturn moment of the crane-plus-load structure for all angles of the counterbalancing arm. It should be noted that the overturning moment created by lifting a load is linearly proportional to the tension in the lifting cable. This means that any change in the effective level arm used for rotating the counterbalance arm will result in an error in the counterbalance moment.

SUMMARY OF THE INVENTION

Unlike rotating counterbalance arms of the prior art which operate on cable tension, the subject counterbalance arm is provided with a constant radius sector attached to the counterbalance arm. The origin of the radius of the sector is its pivot point and coincides with the pivot point of the arm and drives the arm at this point. Thus, the center of rotation of the sector corresponds to the pivot point for the arm such that by rotation of the sector, the arm moves or is pivoted about the same point. A drive system for the counterbalance arm is arranged such that the sector is rotated by applying tension to a drive cable which is anchored to the sector and which is carried in a groove at the periphery of the sector. In one embodiment the drive cable tension is supplied from the cable which supports the load. In any event, the force which is applied to move the counterbalance arm is applied at a constant radius regardless of the angle that the counterbalance arm makes with respect to the rest of the crane. The cable thus acts to provide a force tangent to the periphery of the sector, with the tangent point being at all times at a fixed distance from the pivot point of the sector and thus the pivot point of the counterbalance arm. This creates a constant length lever arm, unlike the variable effective lever arms of the prior art. Thus the counterbalance moment created is linearly proportional to the tension in the cable.

In one embodiment, the load-bearing or support cable coupled to the object to be lifted runs over an idler pulley at the end of a fixed-length boom, and then to a second idler pulley vertically disposed beneath a floating pulley. These latter two pulleys together comprise a block and tackle. The support cable runs over the floating pulley and then down to a winch which is used to raise and lower the load. A drive cable runs from the housing of the floating pulley through a third idler pulley, and then around the sector to a point on the sector periphery where it is anchored. The sector being attached to the pivot of the pivoting counterbalance arm rotates the arm in response to the tension of the support cable as the load is being lifted. The radius of the sector is a predetermined fraction of the horizontal distance (L) between the center of gravity (C.G.) of the crane and the load lifting block at the end of the boom, with the fraction being directly related to the mechanical advantage of the block and tackle portion of the system. For a mechanical advantage of 2 for the system described above, the radius of the sector is L/2. For a block and tackle system providing a mechanical advantage of 4, the radius of the sector is L/4. Thus, sector radius may be minimized relative to the boom length by the utilization of multiple blocks for the block and tackle portion of the system.

The result, for fixed-length booms, is that the crane is dynamically stablized. Prior to the lifting of the object, the counterbalance arm is in a downward vertical position and is pivoted such that its pivot point, the center of gravity of the crane, and the center of gravity of the counterbalance arm are located along a single vertical axis. Assuming that T represents the support cable tension and L represents the horizontal distance between the center of gravity of the crane and the load lifting block on the boom end in the above-described embodiment for a mechanical advantage of 2, the tension on the drive cable from the floating pulley to rotate the sector is 2T acting on a radius of L/2.2T acting on a radius or lever arm $L/2(2T \times L/2)$ provides a torque to the counterbalance arm equal to TL. This torque displaces the center of gravity of the counterbalance arm a distance of $X_{CB}$. Therefore the counterbalancing moment created is equal to the weight of the counterbalance $W_{CB}$ times $X_{CB}$. The counterbalance moment $W_{CB}$ times $X_{CB}$ must be equal to the torque applied to the arm (TL) for the arm to be in static equilibrium.

It can be shown that while it is desirable that the counterbalance pivot be located on the vertical axis which includes the center of gravity of the crane, horizontal offsetting of the pivot from this axis is automatically accommodated if weights are added in a direction opposite the offset direction opposite the offset direction to bring the crane into initial balance or equilibrium. Note that it is commonplace to use weights for initially offsetting the weight of the crane boom to bring the center of gravity of the crane to the longitudinal axis of the tower. It will be appreciated that the sector and counterweight can be conveniently positioned anywhere with respect to the crane structure as long as the sector radius is determined with respect to the horizontal distance between the center of gravity of the resulting crane structure and the lifting block attached to the boom.

Increasing the number of blocks in the block and tackle portion of the system increases the mechanical advantage and reduces the radius of the sector by the amount of the mechanical advantage such that for a four block system, the tension in the drive cable is 4T, whereas the radius may be reduced to L/4.

The maximum overturning moment that can be equalized by the counterbalance arm is obtained when the counterbalance arm is rotated 90° from the vertical position. $X_{CB}$ reaches a maximum at this position. Varying the counterbalance weight $W_{CB}$ or the length of the counterbalance arm will increase or decrease the maximum counterbalancing capacity of the crane.

In a further embodiment, variable-length booms or traveling crane systems may take advantage of the exact balancing, both dynamic and static, afforded by the application of cable tension about a constant radius sector. In one embodiment, the boom is pivoted about a horizontal axis at a point on a vertical axis which includes the center of gravity of the crane. The boom is provided with a secondary sector of constant radius, with the secondary sector being secured to the boom at its point. A cable anchored to this secondary sector runs over the periphery of the secondary sector around the floating pulley, and to the primary constant radius sector which drives the rotating counterbalance arm. The radius of the primary and secondary sectors are equal. The origin of the radius of this primary sector and the pivot point of the counterbalance arm are co-located as before. Thus not only is cable tension operating at a constant radius utilized to move the counterbalance arm in an angle-independent fashion, but also this same cable operating about the sector carried by the boom causes the boom to be rotated about its pivot in an angle-independent manner.

In this embodiment, a separate winch is utilized to raise the load. The boom is pivoted at the tower such that when the first winch is operated, the boom moves downwardly, tripping a limit switch which operates through a motor control circuit to power a second winch at the same time stopping the first winch. The cable from the second winch, by virtue of a floating pulley, serves both to raise the downwardly moving boom while at the same time rotating the counterbalance. The cable of the second winch by virtue of a floating pulley applies a force to both the counterbalance arm sector and the boom sector. Because these sectors are the same radius the effective torque acting on the counterbalance arm and the boom are equal and opposite in magnitude.

Since the angle-dependent linkages of the prior art are not utilized, the subject system can be made to operate such that the counterbalancing moment exactly equals the overturn moment regardless of the angular positions of either the counterbalance arm or the boom.

In a further embodiment, the secondary sector is replaced by a lever fixed at right angles to the boom, and the drive cable acts on this lever at right angles thereto for the small boom angle changes involved. In preferred embodiments, the sector radii for the primary and secondary sectors are the same, as is the correspondence between the length of the fixed lever and the primary sector.

BRIEF DESCRIPTION OF THE DRAWINGS

These and other features of the subject invention will now be described in connection with the detailed description taken in conjunction with the drawings of which.

DETAILED DESCRIPTION OF THE INVENTION

Figure 1A:
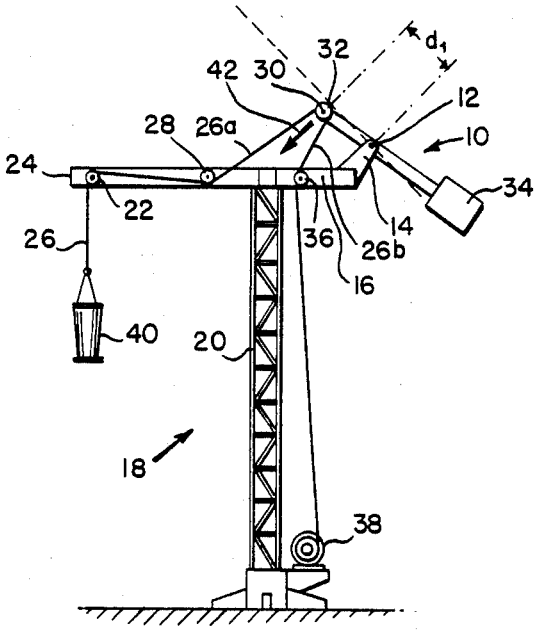
FIG. 1A (PRIOR ART)
FIGS. 1A and 1B schematically depict one prior art tension-driven counterbalance arm configuration, illustrating the difference in effective lever arm for different angular positions of the counterbalance arm.
Figure 1B:
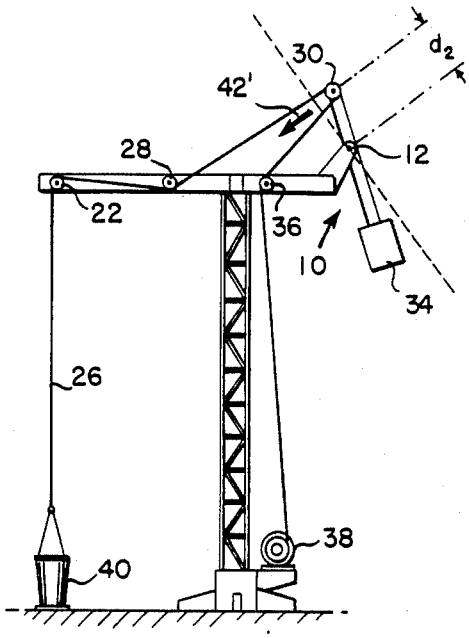
FIG. 1B (PRIOR ART)

Referring now to FIGS. 1A and 1B, a prior art tension-driven rotating counterbalance arm 10 is pivoted about a fixed pivot point 12 on an extension 14 secured to a boom 16 of a crane generally indicated at 18, in which boom 16 is mounted to a vertical tower 20. An idler pulley 22 is pivoted at end 24 of boom 16, and a support cable 26 runs over idler pulley 22 to an idler pulley 28 mounted to boom 16. From pulley 28, cable 26 runs around a further idler pulley 30 mounted to end 32 of counterbalance arm 10, with a counterbalance weight 34 being mounted at the other end of the arm. Cable 26 then passes over idler pulley 36 mounted to boom 16 and thence to a winch 38. In the position shown in FIG. 1A, when an object 40 is hoisted, a force illustrated by arrow 42, which is the resultant force of the tension of cable portions 26*a* and 26*b*, acts through idler pulley 30 in a direction centrally between cable portions 26*a* and 26*b*. It will be appreciated that the effective lever arm is the distance perpendicular to resultant force vector 42 between pivot 12 and vector 42. In FIG. 1A this effective lever arm is illustrated by $d_1$.

The situation depicted in FIG. 1A is the result of having hoisted load 40. Prior to the hoisting of load 40, or more specifically, as the tension increases in cable 26, the resultant vector here shown at 42' is at a different angle and magnitude than vector 42 of FIG. 1A. Note that the effective lever arm, herein illustrated at $d_2$, is shorter than the effective lever arm illustrated in FIG. 1A. This change in the effective length of the lever arm with a change in angle of the counterbalance arm results in a substantial mismatch of the counterbalance moment vis-a-vis the overturn moment of the crane.

Figure 2:
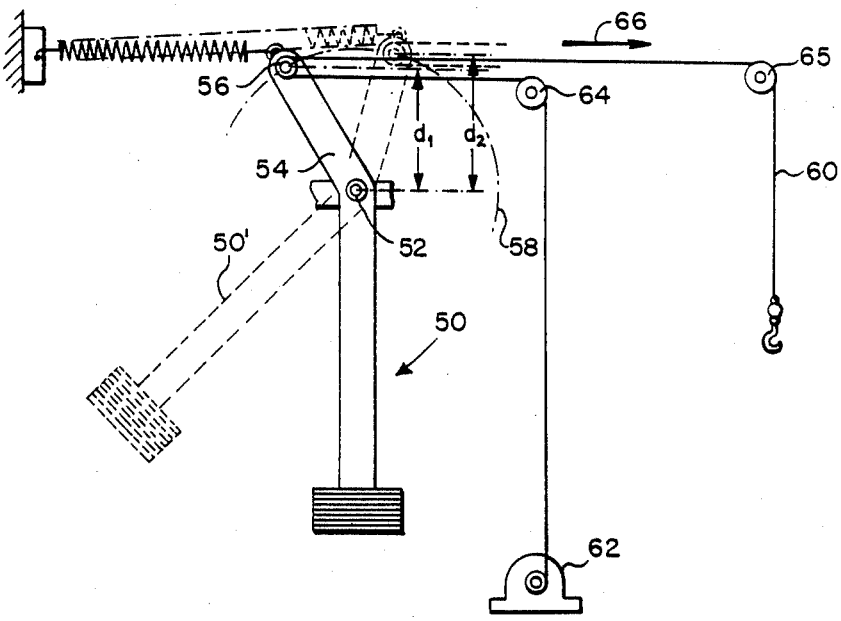
FIG. 2 (PRIOR ART)
FIG. 2 is a diagrammatic illustration of another type of rotating counterbalance arm system, also illustrating the difference in effective lever arm for differences in position of the counterweight.

Referring now to FIG. 2, a different type of tension-operated rotating counterbalance arm is shown in which a rotating counterbalance arm 50 is rotated about pivot point 52 such that an angular extension 54 having a fixed block 56 moves in an arc 58 as tension is applied to support cable 60 via winch 62. Here cable 60 runs over a fixed idler pulley 64, through block 56 and over a fixed idler pulley 65 carried at the end of the boom (not shown).

The result is that for the unloaded or rest position of arm 50, the effective lever arm is defined by $d_1$, whereas this effective distance varies when the counterbalance arm 50 arrives at the dotted position indicated by 50' such that the effective lever arm is now defined by $d_2$. In this case, the resultant force vector, as illustrated by arrow 66, is always along the horizontal, and the lever arm is therefore measured in a vertical direction.

What can be seen from FIGS. 1 and 2 is that the effective lever arm utilized to move the counterbalance arm varies in length and is therefore dependent on the angular displacement of the counterbalance arm. This being the case, the movement of the counterbalance arm in response to cable tension does not provide for a counterbalancing moment which exactly matches and is opposite to the overturn moment of the crane boom structure.

Figure 3:
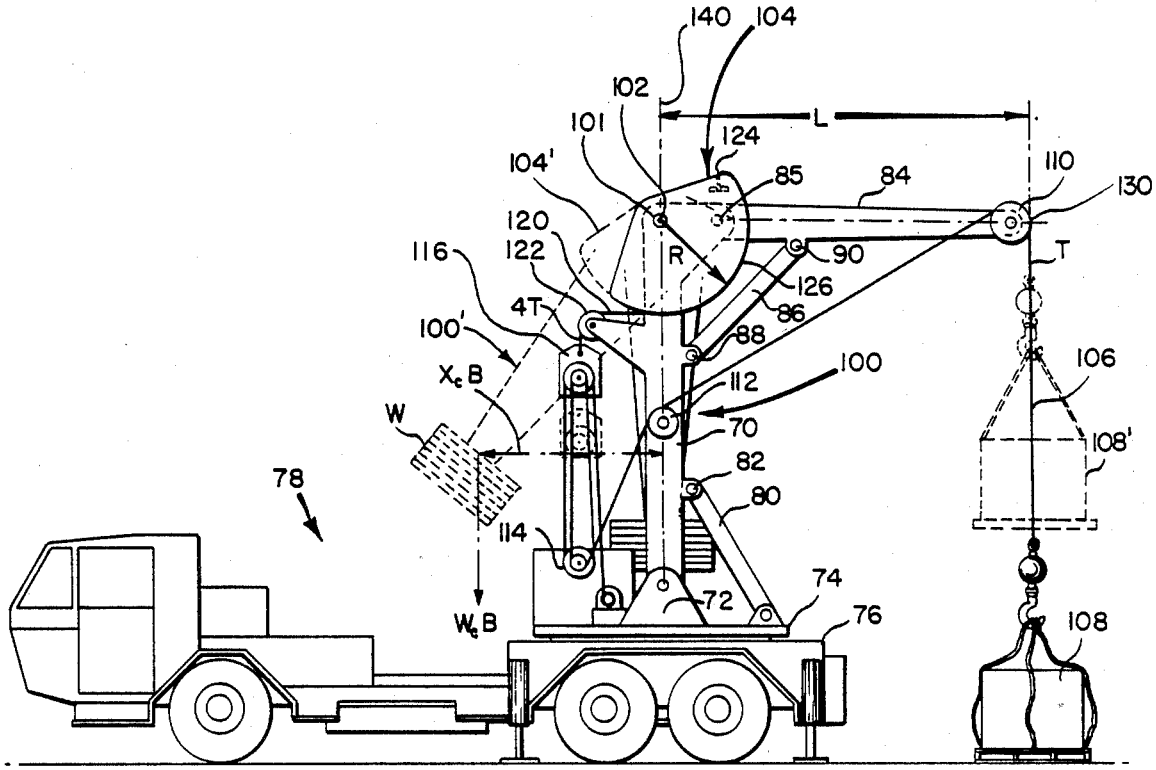
FIG. 3 is a diagrammatic illustration of a truck-mounted crane utilizing the subject constant-radius sector for the driving of the rotating counterbalance arm.

Referring now to FIG. 3, a self-balancing crane, in this embodiment, truck-mounted, is illustrated to include a tower 70 pivotably mounted at bracket 72 to a turntable 74 carried by platform 76 of a truck body 78.

Tower 70 is held in its vertical upright position by a strut 80 demountably coupled between turntable 74 and a projection 82 on tower 70.

A fixed length boom 84 extends at right angles to tower 70, with this boom being pivotably mounted to the top portion of the tower. A demountable strut 86 maintains the orthogonal relation of boom 84 with respect to tower 70, with the strut being mounted between projections 88 and 90 as illustrated.

A rotating counterbalance arm 100 shown depending vertically from a pivot point 102 is pivotally mounted to the top of tower 70. A constant radius sector 104 is fixedly attached to counterbalance arm 100 by a shaft 101 at pivot point 102 such that when sector 104 is rotated clockwise, the counterbalance arm 100 is also rotated clockwise. This situation is illustrated by dotted line 104' to indicate the rotation of the sector, and dotted line 100' to indicate the rotated position of the counterbalance arm.

A support cable 106 runs from a load 108 over an idler pulley 110 at the end of boom 84 over a fixed idler pulley 112 and to a fixed block 114. From this block, it runs to a floating block or pulley 116 which, together with block 114, form the blocks of a block and tackle arrangement, providing a mechanical advantage the magnitude of which is defined by the number of blocks. Block 116 drives sector 104 via a drive cable 120 which runs over a fixed idler pulley 122. One end of cable 120 is secured to block 116, whereas the other end of this cable is secured at 124 to sector 104 after having run about the constant radius periphery of the sector. In a preferred embodiment, the periphery of the sector here illustrated at 126 is notched to provide a channel for cable 120.

The radius of sector 104 is set in accordance with the distance L between pivot point 102 and the tangent point 130, and in accordance with the mechanical advantage afforded by the block and tackle arrangement afforded by blocks 114 and 116. In the illustrated embodiment with a mechanical advantage of 4 for the block and tackle assembly and with a tension T on cable 106, then cable 120 carries a tension of 4T thereby establishing a radius for sector 104 of L/4.

When load 108 is lifted to the position indicated by dotted outline 108', the tension T in cable 106 varies dynamically as does cable 120 such that counterbalance arm 100 is swung in a vertical plane in an upward direction, thereby to increase the distance $X_{CB}$ of the center of mass of the counterbalance arm such that the counterbalance weight is at the appropriate angle and operates as illustrated by arrow $W_{CB}$ at a distance $X_{CB}$ from a vertical axis 140 which includes the center balance of the crane and pivot point 102. By virtue of utilizing a constant radius sector to drive the rotating counterbalance arm, the drive for the arm is made angle-independent. This is because the effective lever arm has a constant length.

Figure 4:
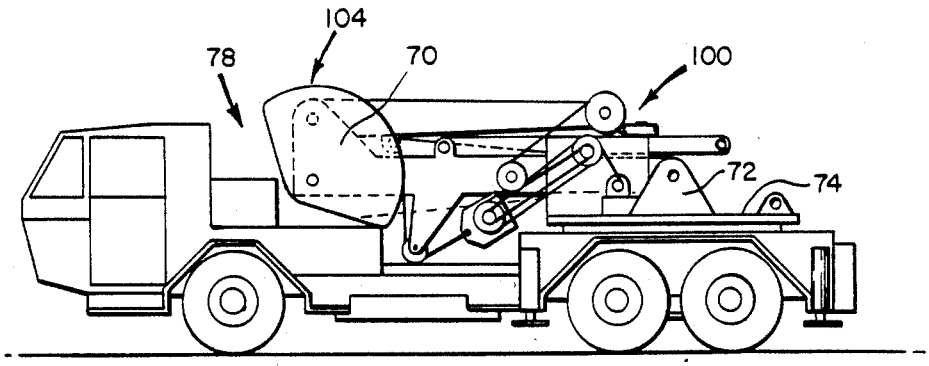
FIG. 4 is a diagrammatic illustration of the truck-mounted crane of FIG. 3 with the crane collapsed onto the truck body.

Referring now to FIG. 4, the crane is shown collapsed onto truck body 78 by virtue of pivoting tower 70 about its lower pivot point on bracket 72 through the release or removal of strut 80 and release or removal of strut 86. As tower 70 is lowered in place, counterbalance arm 100 has its associated weight contacting top surface of turntable 74 where it rests during transport of the crane. The end of the tower carrying the sector may be supported in any suitable manner, thereby for providing a collapsible self-balancing crane in one embodiment.

Figure 5:
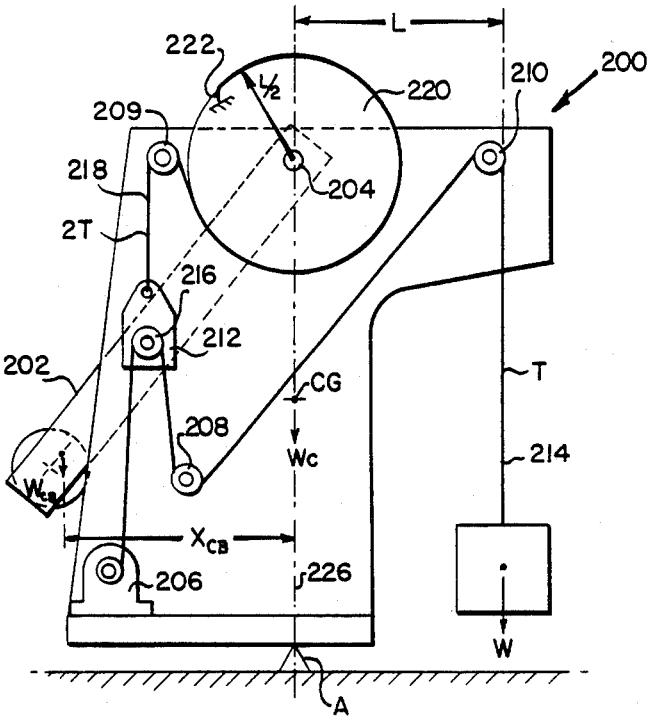
FIG. 5 is a schematic illustration of the operation of the subject counterbalancing system illustrating the operation of the constant-radius sector and its position at the pivot point of the rotating counterbalance arm.
Figure 6:
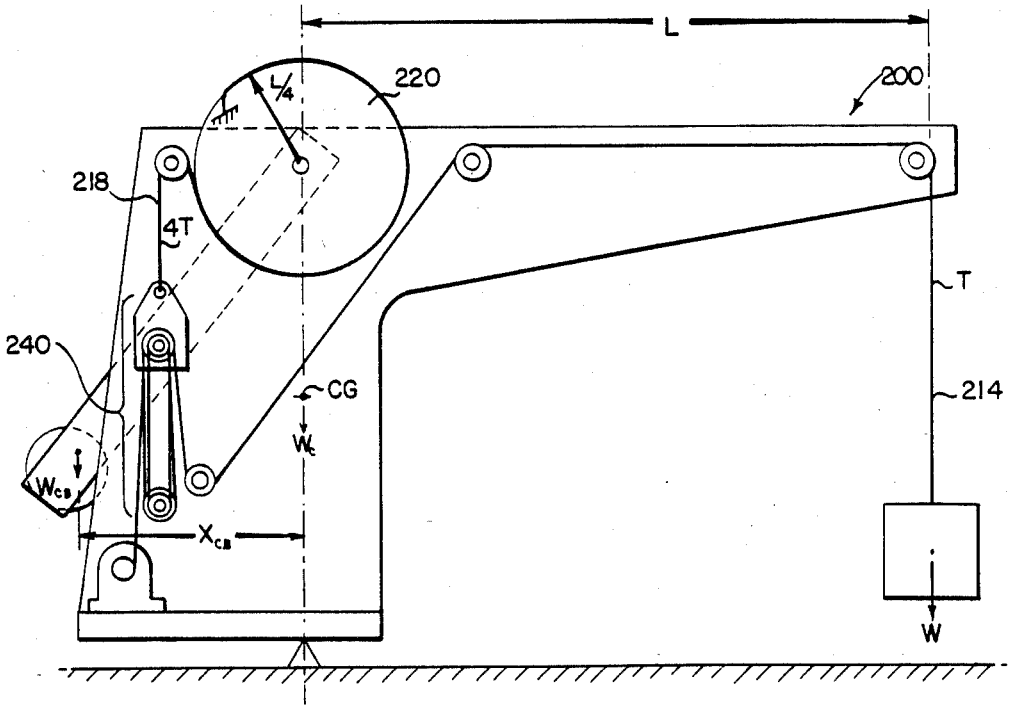
FIG. 6 is a diagrammatic illustration of the use of the same radius sector in FIG. 5 for an increased boom length and increased mechanical advantage block and tackle system.

Referring to FIGS. 5 and 6, the various relationships for the self-balancing crane of FIG. 3 are shown in diagrammatic form for ease of description. Referring to FIGS. 5 and 6, the crane is diagrammatically illustrated as consisting of a frame 200 and a counterbalance arm 202 which is pivoted at 204. A winch 206 is provided at the base of frame 200. The frame is also provided with idler pulleys 208, 209, and 210. A pulley block 212 is provided in a floating manner such that a support cable 214 runs over idler pulleys 210 and 208, around a pulley 216 carried by block 212, and then down to winch 206. A drive cable 218 runs from block 212 around idler pulley 209, around sector 220, where it is anchored as shown at 222.

To illustrate the stability of this crane configuration, it can be assumed that there is a single support at A and that the sum of the moments about that point can be taken. When there is no load lifted by the crane, the center of gravity of the crane and the center of gravity of the counterbalance arm both act through point A, which lies along vertical axis 226. Therefore, the moment about point A is equal to zero, e.g., $$W_C(0)+W_{CB}(0)=0$$

In this equation, $W_C$ is the weight of the crane minus the counterbalance arm weight, and $W_{CB}$ is the weight of the counterbalance arm. As the load is picked up by the crane, tension T pulls on the crane at a moment arm of L from point A. This causes an overturning moment equal to TL. A tension of 2T acts on the counterbalance arm sector at a lever arm or moment arm of L/2. In other words, as a result of the tension in cable 214 due to the lifting of the load, a torque of 2T(L/2), or TL, is applied to the counterbalance arm. This displaces the center of gravity in the counterbalance arm a distance of $X_{CB}$ to effectuate or create a counterbalancing moment. It will be appreciated that the counterbalancing moment is equal to the torque applied to the counterbalance arm. The counterbalancing moment equals TL, and the overturning moment equals TL. Therefore, the crane is in exact balance. The maximum capacity of the crane is defined by the load that will rotate the counterbalance arm 90°. For all loads less than this, the crane will remain in perfect balance.

Referring to FIG. 6, it may be desirable to increase the length of the boom with respect to the radius of the counterbalance arm sector or pulley. By utilizing a block and tackle arrangement described hereinabove, here illustrated at 240, the radius of sector 220 may be reduced in accordance with the mechanical advantage of the block and tackle arrangement. For the embodiment of FIG. 6, with a mechanical advantage of 4 for the block and tackle arrangement, and with a tension T for support cable 214, a tension 4T exists for cable 218. In order that the overturn moment match the counterbalance moment, the constant radius sector must be made L/4 such that $4T(L/4)=TL$. This means that for the same size sector, the boom length can be extended by a factor of the mechanical advantage afforded by the block and tackle arrangement.

Figure 7:
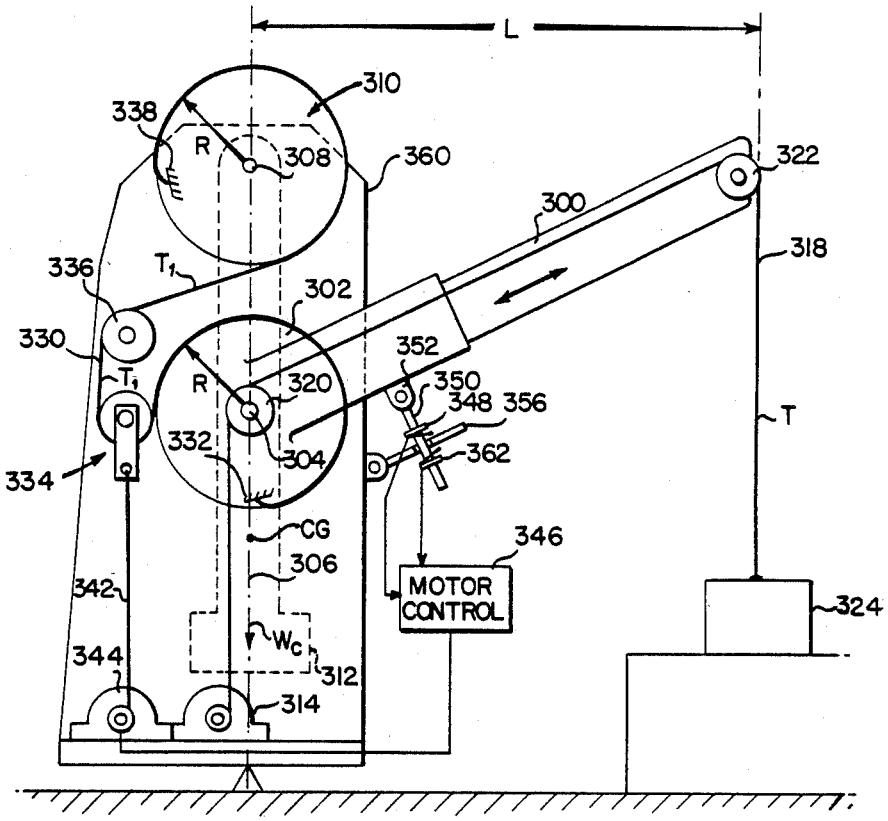
FIG. 7 is a diagrammatic illustration of a variable-length boom utilized in combination with a constant-radius sector-driven counterbalance arm.

Referring now to FIG. 7, a variable length boom may be accommodated while at the same time maintaining the angle independence of the rotating counterbalance arm. In this embodiment, a variable length boom 300 carries secondary sector 302 affixed thereto which pivots about point 304. Point 304 lies on an axis 306 which includes the center of balance of the crane and a pivot point 308 of primary sector 310. A counterbalance arm indicated by dotted line 312 is pivoted at point 308 and is attached to sector 310 at this pivot point. Both the primary and the secondary sectors have a constant radius, in this case R, with a winch 314 operating via cable 318 over idler pulleys 320 and 322 to lift load 324. A cable 330 is anchored at 332 to secondary sector 302 and runs about its periphery and through a block 334 around an idler pulley 336 and about the periphery of sector 310 to which it is anchored at 338. Block 334 is coupled via cable 342 to a second winch 344 as illustrated. Note, pivot points 304 and 308 are located on the vertical axis 306 which passes through the center of gravity of the crane.

Winch 344 is controlled by motor control unit 346 which operates to pull bloc 334 down when a limit switch 348 on arm 350 pivoted at one end 352 to boom 300 is tripped. The position of boom 300 is determined by arm 356 which is pivoted to frame 360. Arm 350 is also provided with a second limit switch 362 such that initially limit switches 348 and 362 straddle arm 356.

In operation, boom 300 moves downwardly as load 324 is lifted upwardly. This triggers limit switch 348 which causes motor control unit 346 to power winch 344 in a direction so as to move block 334 downwardly. This simultaneously causes the rotation of the primary and secondary sectors such that boom 300 is rotated upwardly or lifted, as is counterbalance arm 312. As boom 300 rises, limit switch 348 becomes deactivated, which causes motor control circuit 346 to deactivate winch 344. In the preferred embodiment, the limit switch 348 is given a considerable amount of overtravel to allow angular displacement of the boom downwardly by a predetermined amount.

On unloading, the arm 300 moves upwardly thereby actuating winch 362 which causes motor control circuit 346 to reverse the direction of winch 344. When winch 344 reverses its direction, boom 300 moves downwardly until such time as switch 362 is deactivated at which time motor control circuit 346 deactivates winch 344.

It will be appreciated that while a simple electrical control system has been described for the movement of the floating block, other electrical control systems, as well as hydraulic control systems, may be utilized to move the floating block and are thus within the scope of this invention.

Figure 8:
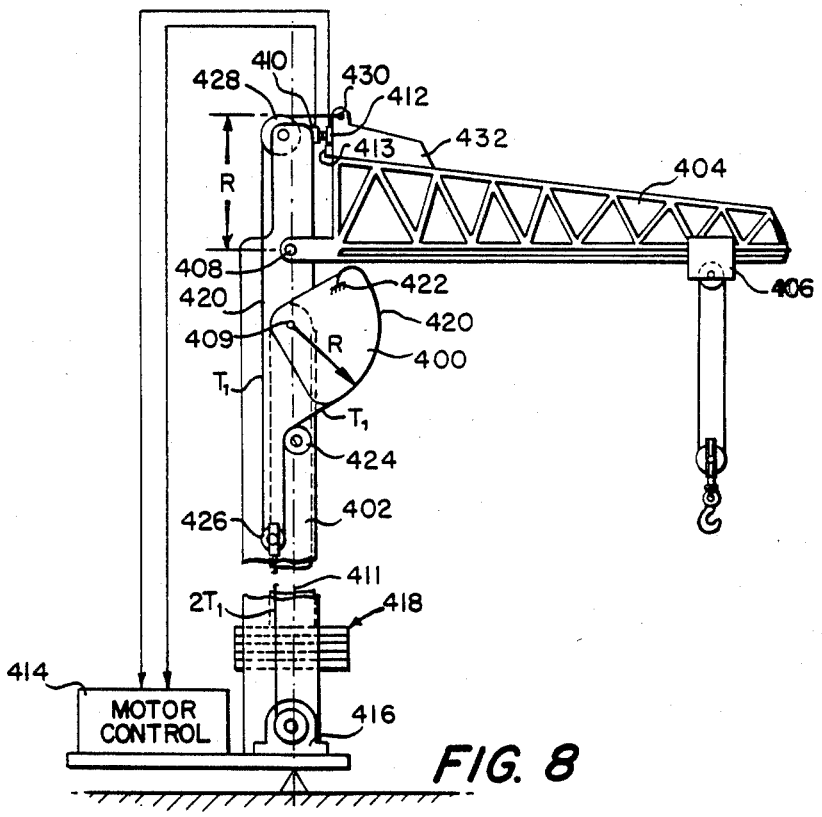
FIG. 8 is a side and diagrammatic illustration of a traveling crane illustrating the utilization of a pivoted crane boom and a constant-radius sector utilized to drive the rotating counterbalance arm.

In the FIG. 7 configuration, since both sectors have constant radius peripheries, complete angle independence is provided. However, angle independence for the boom is not an absolute requirement such as is illustrated in FIG. 8 in which a tower crane or travelling crane embodiment is provided with only a single sector 400 on tower 402. Sector 400 is pivoted about a point 409 as illustrated. The travelling crane illustrated in FIG. 8 includes a boom 404 and a hoist 406 which travels horizontally along the bottom of the boom. The boom is hinged to tower 402 at a pivot point 408, and its angular position is determined by limit switches 410 and 412 which are connected to a motor controller 414 which controls a winch 416 utilized both to maintain the horizontal position of boom 404 and to provide for the movement of counterbalance arm 418. Note that boom position is sensed through the use of an arm 413 postioned between limit switches 410 and 412. In this embodiment, a cable 420 is anchored at 422 to sector 400 from whence it runs over an idler pulley 424 through a block 426 over an idler pulley 428 and to a point 430 on a bracket 432 carried by boom 404. The torque balance equations which provide for the equality of the overturn movement and the counterbalance moment require in FIG. 7 that the radii of the primary and secondary sectors be the same. This is because the overturn moment of the boom and the counterbalancing moment of the counterbalance arm are equal to the torque applied to them about their respective pivot point. Since the torques applied to them are equal, equilibrium is maintained.

As illustrated in FIG. 8, radius R for sector 400 is duplicated without the utilization of a constant radius sector for the boom through the utilization of idler pulley 428 and bracket 432 which provides a fixed lever orthogonal to the longitudinal axis of the boom. The reason that a secondary sector is not necessary is that the boom is only permitted to move or pivot slightly, with the pivoting being provided to provide a means for sensing the overturn moment, thereby to provide a feedback system for winch 416. Note, in this figure pivot points 408 and 409 lie on the vertical axis 411 which passes through the center of gravity of the crane.

In operation, with increasing weight or tension provided by hoist 406, boom 404 moves downwardly, and limit switch 412 is triggered to energize winch 416, thereby to pull block 426 in a downward direction for the movement of counterbalance arm 418 which is to be swung upwardly. Here, too, the winch provides both for the upward movement of boom 404 and the upward movement of counterbalance arm 418. When boom 404 moves upward sufficiently, limit switch 412 opens and motor control unit 414 stops winch 416. When lowering the load, boom 404 moves upward, limit switch 410 is contacted, and motor control unit 414 reverses winch 416 until limit switch 416 is released. Since in both the FIGS. 7 and 8 embodiments the tension operates at exactly the same lever arm for both the boom and the sector controlling the counterweight, the torques cancel each other out, and the system is in both dynamic and static balance.

The invention is not to be limited by what has been particularly shown and described except as indicated in the appended claims.

What is claimed is:

1. A self balancing crane, comprising:

a frame with a center of gravity and a horizontal boom portion for lifting a load "T" at a distance "L" from the center of gravity and producing an overturn moment thereby equal to "TL";

a constant radius sector with a drive cable engaging peripheral portion;

a counterbalance arm with a first end and a second end;

means pivotally mounting said sector and the first end of said counterbalance arm to said frame along a common rotation axis for providing a counterbalance moment;

a counterweight balance mounted on said second end of said counterbalance arm;

drive cable means with a first and a second end;

means connecting the last said first end to the constant radius sector;

means for providing a mechanical advantage;

means connecting said mechanical advantage providing means to said second end of said drive cable means for movement relative to said frame;

a first idler pulley means mounted on said frame;

said drive cable means extending from said constant radius sector over said peripheral portion of said constant radius sector and over first idler pulley meas to said mechanical advantage providing means;

second idler pulley means and load hoist winch means mounted on said frame;

load cable means, said load cable means extending from said winch means and coupled to said mechanical advantage providing means and over said second idler pulley means and then to said load handled by said crane;

a constant radius sector having a preselected radius "R";

the mechanical advantage providing means having a preselected mechanical advantage "A";

said preselected radius "R" and said preselected mechanical advantage "A" being selected such that said counterbalance moment "ATR" substantially cancels said overturn moment "TL".

* * * * *